US006944952B1

(12) United States Patent
Tseng

(10) Patent No.: US 6,944,952 B1
(45) Date of Patent: Sep. 20, 2005

(54) SHAVING SYSTEM

(75) Inventor: Mingchih M. Tseng, Hingham, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 08/926,819

(22) Filed: Sep. 10, 1997

Related U.S. Application Data

(63) Continuation of application No. 08/461,318, filed on Jun. 20, 1995, now Pat. No. 6,594,904, which is a continuation-in-part of application No. 08/269,495, filed on Jul. 1, 1994, now abandoned.

(51) Int. Cl.[7] ..... B26B 21/40; B26B 21/44

(52) U.S. Cl. ..... 30/41; 30/41.7; 116/208; 116/DIG. 41

(58) Field of Search ..... 30/40.2, 41, 41.5, 30/41.7, 50, 84, 90, 345, 537, 538; 116/208, 334, 335, DIG. 41

(56) References Cited

U.S. PATENT DOCUMENTS

| | | | | |
|---|---|---|---|---|
| 1,292,982 A | * | 1/1919 | Wolf | 132/290 X |
| 1,497,647 A | | 6/1924 | Smith | |
| 1,565,680 A | | 12/1925 | Silverwood | |
| 2,004,087 A | | 6/1935 | Testi | |
| 2,040,345 A | | 5/1936 | Taylor | |
| 2,068,085 A | | 1/1937 | Stanley | |
| 2,098,038 A | | 11/1937 | Gore | |
| 2,548,959 A | | 4/1951 | Eisenberg et al. | |
| 2,568,047 A | | 9/1951 | Anderson | |
| 2,600,880 A | | 6/1952 | Karie | |
| 2,703,451 A | | 3/1955 | Hensel et al. | |
| 2,814,104 A | | 11/1957 | Miller | |
| 3,136,865 A | | 6/1964 | Meyer | |
| 3,722,090 A | | 3/1973 | Dawidowicz | |
| 3,810,479 A | | 5/1974 | Miles | |
| 3,879,844 A | | 4/1975 | Griffiths | |
| 3,895,437 A | | 7/1975 | DiBuomo | |
| 3,909,939 A | | 10/1975 | Dootson | |
| 3,939,560 A | | 2/1976 | Lyall | |
| 3,992,336 A | | 11/1976 | Faucher et al. | |
| 4,170,821 A | | 10/1979 | Booth | |
| 4,189,832 A | | 2/1980 | Harper et al. | |
| 4,211,006 A | | 7/1980 | Halaby et al. | |
| 4,310,968 A | | 1/1982 | Buik et al. | |

(Continued)

FOREIGN PATENT DOCUMENTS

| | | |
|---|---|---|
| DE | 3533238 | 3/1987 |
| EP | 0 254 491 | 1/1988 |
| EP | 348 627 | 1/1990 |
| FR | 2 323 502 | 4/1977 |

(Continued)

OTHER PUBLICATIONS

Levy, Plastics Extrusion Technology Handbook, Industrial Press Inc., pp. 168–188 (1981).

(Continued)

*Primary Examiner*—Clark F. Dexter
(74) *Attorney, Agent, or Firm*—Fish & Richardson P.C.

(57) ABSTRACT

A shaving unit that comprises at least one blade and a skin engaging member that has a surface for engaging the user's skin adjacent the blade edge. The shaving unit may be of a disposable cartridge type adapted for coupling to and uncoupling from a razor handle or may be integral with a handle so that the complete razor is discarded as a unit when the blade or blades become dulled. The blade edge (or edges) cooperate with skin engaging surfaces to define a shaving geometry. The skin engaging member is comprised on an elongated sheath (or skin engaging layer) made of a mixture of water insoluble matrix and an effective amount of shaving aid and a rigid core (or non-skin engaging layer) extending axially through out said sheath. The axial position of the core need not be through the central axis.

8 Claims, 4 Drawing Sheets

U.S. PATENT DOCUMENTS

| | | | | |
|---|---|---|---|---|
| 4,481,262 | A | | 11/1984 | Shida et al. |
| 4,535,537 | A | | 8/1985 | Ferraro et al. |
| 4,562,644 | A | | 1/1986 | Hitchens |
| 4,586,255 | A | | 5/1986 | Jacobson |
| 4,709,476 | A | | 12/1987 | Shurtleff et al. |
| 4,741,103 | A | | 5/1988 | Hultman |
| 4,777,722 | A | | 10/1988 | Trotta |
| 4,802,255 | A | | 2/1989 | Breuer et al. |
| 4,813,131 | A | | 3/1989 | Gruner |
| 4,831,731 | A | | 5/1989 | Eitis |
| 4,850,106 | A | | 7/1989 | Braun et al. |
| 4,866,844 | A | | 9/1989 | Burout |
| 4,872,263 | A | | 10/1989 | Etheredge |
| 4,875,287 | A | | 10/1989 | Creasy et al. |
| 4,931,051 | A | * | 6/1990 | Castello ..... 604/361 |
| 5,001,832 | A | | 3/1991 | Althaus |
| 5,010,646 | A | | 4/1991 | Neamtu |
| 5,056,221 | A | | 10/1991 | Thoene |
| 5,056,222 | A | | 10/1991 | Miller et al. |
| 5,063,667 | A | | 11/1991 | Jacobson |
| 5,067,238 | A | | 11/1991 | Miller et al. |
| 5,072,512 | A | | 12/1991 | Noujain |
| 5,095,619 | A | | 3/1992 | Davis et al. |
| 5,113,585 | A | | 5/1992 | Rogers et al. |
| 5,134,775 | A | | 8/1992 | Althaus et al. |
| 5,249,361 | A | | 10/1993 | Apprille, Jr. et al. |
| 5,340,581 | A | | 8/1994 | Tseng et al. |
| 5,345,680 | A | | 9/1994 | Vreeland et al. |
| 5,388,331 | A | | 2/1995 | Doroodian-Shoja |
| 5,440,808 | A | | 8/1995 | Wexler |
| 5,454,164 | A | | 10/1995 | Yin et al. |
| 5,906,834 | A | | 5/1999 | Tseng |
| 6,295,733 | B1 | * | 10/2001 | Wexler et al. ..... 30/41 |

FOREIGN PATENT DOCUMENTS

| | | |
|---|---|---|
| GB | 259 288 | 10/1926 |
| GB | 1 444 545 | 8/1976 |
| GB | 1 557 177 | 12/1979 |
| GB | 2 024 082 | 1/1980 |
| WO | 90/05047 | 5/1990 |
| WO | WO 9604112 A1 | 2/1996 |

OTHER PUBLICATIONS

Material Safety Data Sheet, Concept Polymer Technologies, Inc., May 1990.
Material Safety Data Sheet, Huntsman Chemical Corp., Dec. 3, 1991.
"Sensor for Women" product literature (copyright 1992).
U.S. Appl. No. 08/731,064, Tseng et al.
U.S. Appl. No. 08/497,194, Tseng et al.
Schick Protector cartridge.
Package back label for Schick Protector cartridge.

* cited by examiner

SHAVING SYSTEM

This application is a continuation of U.S. application No. 08/461,318, filed Jun. 20, 1995, now U.S. Pat. Ser. No. 6,594,904, which is a continuation-in-part of U.S. Ser. No. 08/269,495, filed Jul. 1, 1994, now abandoned.

BACKGROUND OF THE INVENTION

1. Field of the Invention

This invention relates to an improved skin engaging member for use in razor blade cartridge assemblies and shaving systems of the wet shave type. The present invention resides broadly in providing the skin engaging cap and/or guard surfaces with configurations which reduce frictional drag of the razor across the skin. This invention also relates to a novel method of manufacturing the skin engaging member of the present invention.

2. Description of the Prior Art

In shaving systems of the wet shave type, factors such as the frictional drag of the razor across the skin, the force needed to sever hairs, and irritation of pre-existing skin damage can create a degree of shaving discomfort. Discomfort, and other problems accompanying wet shaving systems, can be alleviated by the application of shaving aids to the skin. Shaving aids may be applied prior to, during, or after shaving. A number of problems accompany the use of pre- and post-applied shaving aids. Pre-applied-shaving aids can evaporate or can be carried away from the site of application by repeated strokes of the razor. Post-applied-shaving aids are not present on the skin during shaving and thus their application may be too late to prevent an unwanted affect. Both pre-applied and post-applied shaving aids add additional steps to the shaving process.

Proposals have been made to incorporate a shaving aid e.g., lubricant, whisker softener, razor cleanser, medicinal agent, cosmetic agent or combination thereof, into a razor, e.g., by depositing a shaving aid in a recess on the razor, by incorporating a shaving aid directly into one or more molded polymeric components of the razor, by adhesively securing a shaving aid composite to the razor, and by use of a mechanical connection between a shaving aid composite and the razor. A water-soluble shaving aid, e.g. polyethylene oxide, has been mixed with non-water-soluble material, e.g., a polystyrene polymer, to form an insoluble polymer/soluble shaving aid composite. The composite has been mounted on razor and shaving cartridge structures, adjacent the shaving edge or edges, of single or multiple blade shaving systems. Upon exposure to water, the water-soluble shaving aid leaches from the composite onto the skin.

Extruded composites with relatively large amounts of shaving agent material (up to 80% by weight) and relatively low amounts of water insoluble matrix material (as little as 20% by weight) are relatively weak and have a tendency towards mechanical failure, both in assembly and in use. Increase in mechanical strength can be obtained with increased amounts of the matrix material. However, such increase reduces the releasability of the shaving agent material.

SUMMARY OF THE INVENTION

In accordance with one aspect of the invention, there is provided a shaving unit that comprises at least one blade and a skin engaging member that has a surface for engaging the user's skin adjacent the blade edge. The shaving unit may be of a disposable cartridge type adapted for coupling to and uncoupling from a razor handle or may be integral with a handle so that the complete razor is discarded as a unit when the blade or blades become dulled. The blade edge (or edges) cooperate with skin engaging surfaces to define a shaving geometry . The skin engaging member is comprised of an elongated sheath (or skin engaging layer) made of a mixture of water insoluble matrix and an effective amount of shaving aid and a rigid core (or non-skin engaging layer) extending axially through out the sheath. The axial position of the core need not be through the central axis.

An object of the present invention is to provide a skin engaging member with improved mechanical strength.

Another object of the present invention is to provide a skin engaging member with improved shaving aid release characteristics.

Yet another object of the present invention is to provide a wear indicating skin engaging member.

These and other objects should be evident from the following:

DESCRIPTION OF PARTICULAR EMBODIMENTS

Figure 1:
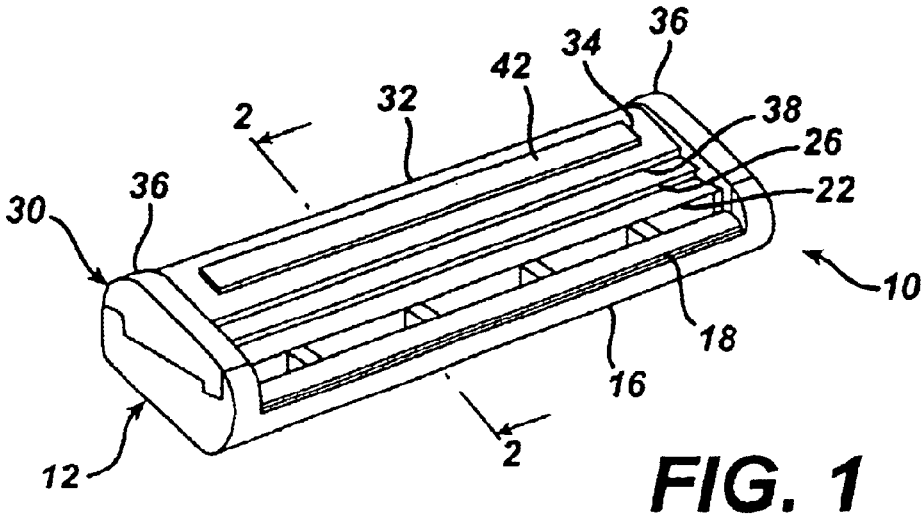
FIG. 1 is a perspective view of a razor unit in accordance with the invention.
Figure 2:
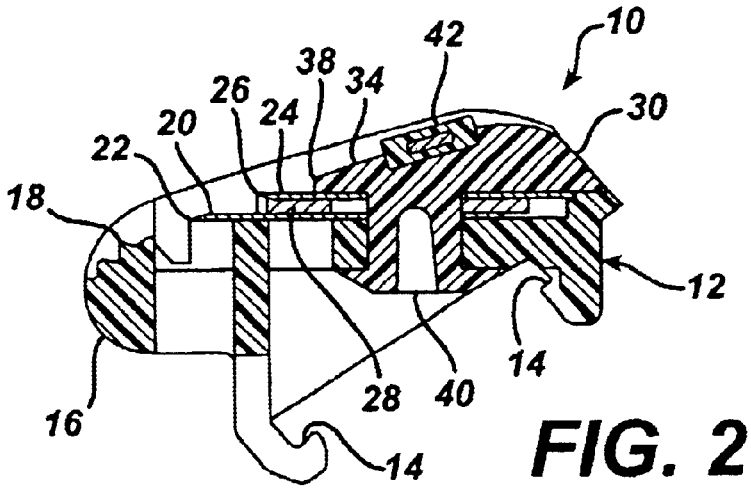
FIG. 2 is a sectional view taken along the line 2—2 of FIG. 1.

The shaving unit (or razor cartridge) 10 shown in FIGS. 1 and 2 includes base or platform member 12 molded of high impact polystyrene that includes integral coupling groove structure 14 for attachment to a razor handle and guard structure 16 that defines a transversely extending forward skin engaging surface 18. On the upper surface of platform 12 are disposed steel leading blade 20 having a sharpened edge 22, steel following blade 24 having sharpened edge 26, and aluminum spacer member 28 that maintains blades 20 and 24 in spaced relation. Cap member 30 is molded of high impact polystyrene and has body portion 32 that defines skin engaging surface 34 that extends transversely between forwardly projecting end walls 36 and has a front edge 38 that is disposed rearwardly of blade edge 26. Integral rivet portions 40 extend downwardly from transversely extending body portion 32 and pass through holes in blades 20 and 24, spacer 28, and platform 12 to secure cap 30, blades 20, 24 and spacer 28 on platform 12. Adhesively affixed to skin engaging surface 34 is skin engaging member 42.

Figure 3:
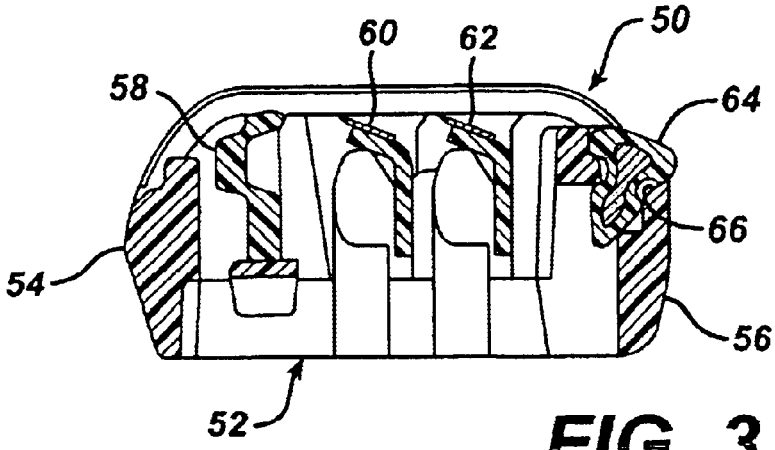
FIG. 3 is a sectional view of another razor unit in accordance with the invention.

The shaving unit (or razor cartridge) 50 shown in FIG. 3 is of the type shown in Jacobson U.S. Pat. No. 4,586,255 and includes body 52 with front portion 54 and rear portion 56. Resiliently secured in body 52 are guard member 58, leading blade unit 60 and trailing blade unit 62. A shaving aid composite in the form of elongated skin engaging member 64 is frictionally locked in opening 66 of rear portion 56.

FIGS. 4–8 generally depict variations on the present invention. As used herein, the term "core" refers to an internal portion of a skin engaging member as examined at the cross-section. The core typically runs through out the skin engaging member along an axis. The axis need not be the central axis. The FIGS. designate the core as 70. Embodiments of the present invention have at least one core element. As used herein, the term "sheath" refers to an outer coating layer(s) over the core 70. The FIGS. designate the sheath as 72.

Figure 4:
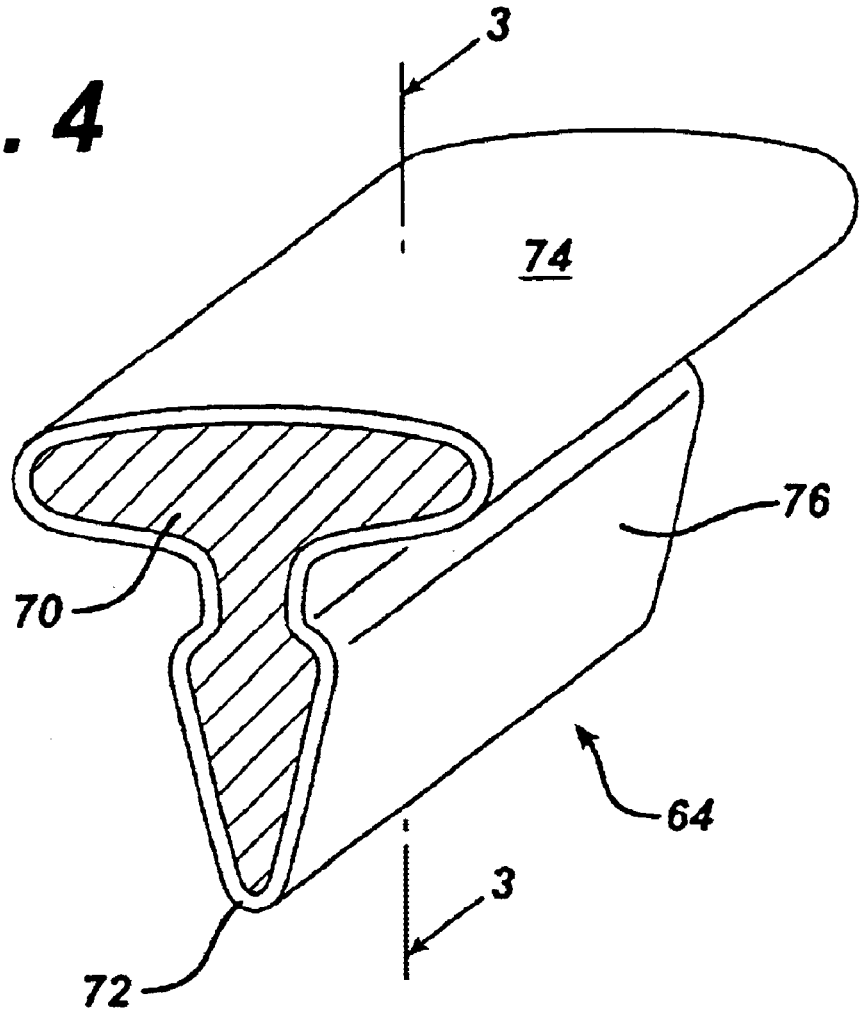
FIG. 4 is an enlarged perspective view of a skin engaging member of the present invention.

Referring now to the drawings, and in particular to FIG. 4, there is shown an embodiment of the elongated skin engaging member 64. The member 64 has a skin engaging surface 74 and an elongated insert member 76. The insert member 76 is designed to frictionally lock in the opening 66 as shown in FIG. 3. The skin engaging member further comprises the rigid core 70 which is surrounded by the sheath 72 made of a mixture of water insoluble matrix and an effective amount of a shaving aid.

The sheath includes from about 0% to about 30% by weight, preferably from about 5% to about 15% of the water insoluble matrix and from about 70% to about 100% by weight of the water soluble shaving aid, preferably from about 85% to about 95% shaving aid. Suitable water insoluble polymers for the matrix include, for example, nylon, ethylene-vinyl acetate copolymer, polyethylene, polypropylene, polystyrene, polyacetyl and combinations. Suitable shaving aids include, for example, polyethylene oxide, polyvinyl pyrrolidone, polyacrylamide, hydroxypropyl cellulose, polyvinyl imidazoline, polyethylene glycol, polyvinyl alcohol, methylcellulose, starch, water soluble vinyl polymers (Carbopol® brand sold by B.F. Goodrich), polyhydroxyethylmethacrylate, silicone copolymers, sucrose stearate, vitamin E, panthenol, aloe, essential oils such as methanol and combinations. The examples illustrate sheaths comprising from 65% to 82% polyethylene oxide.

The sheath may include additional components such as: plastisizers, such as polyethylene glycol; beard softeners, such as Kraton G 13 A; additional lubricants, such as silicone oil, Teflon® polytetrafluoroethylene powders (manufactured by DuPont), and waxes; shaving aids, such as menthol, eugenol, eucalyptol, safrol and methyl salicylate, fillers, such as calcium carbonate, mica and fibers; tackifiers such as Hercules Regalrez 1094 and 1126; fragrances; antipruritic/counterirritant materials such as Frescolat; antimicrobial/keratolytic materials such as Resorcinol; anti-inflammatory agents such as Candilla wax and glycyrrhetinic acid; astringents such as zinc sulfate; surfactants such as pluronic and iconol materials; comptibilizers such as styrene-b-EO copolymers; and, blowing agents such as Uniroyal Celogen Aznp 130. These additives may leach from the surface to provide improved shaving. These components could be dispersed throughout the sheath or alternatively, a second, outer sheath containing the additional element could be extruded or merely coated over the primary sheath.

The present skin engaging member is produced by a coextrusion process whereby a rigid core displaces a portion of the sheath. The nature and relative portions of the sheath and core polymeric materials are such that the skin engaging member has adequate mechanical strength, both as initially produced and after a significant amount of water soluble material has been leached out, the quantity of the water-soluble material being sufficient to provide effective shaving assistance, such as lubrication, for the entire expected life of the blade or blades. The function of the core is not only to provide additional rigidity but to displace trapped shaving aid. In conventional skin engaging members, such as those described in U.S. Pat. Nos. 5,063,667; 5,095,619; and 5,113,585, a significant amount of shaving aid is trapped within the insoluble matrix. By displacing it closer to the skin engaging surface 74, diffusional paths are reduced and more efficient delivery is achieved. Furthermore, the core provides additional mechanical strength for the attaching mechanism, if used.

The core must have sufficient mechanical strength and rigidity to provide adequate mechanical strength to the entire skin engaging member, both as initially produced and after a significant amount of water soluble material has been leached out of the sheath. Preferably, the core material can be made from a water insoluble polymer or a blend consisting of at least about 50%of non-water soluble plastic resin to prevent the core from disintegrating. Water-soluble polymers for use in such blends include polyethylene oxide, polyvinyl pyrrolidone; polyacrylamide, hydroxypropyl cellulose, polyvinyl imidazoline, polyethylene glycol, polyvinyl alcohol, me-hylcellulose, starch, water-soluble vinyl polymers (Carbopol® brand sold by B.F. Goodrich), polyhydroxyethylmethacrylate, and combinations thereof. Suitable water insoluble polymers for use in the core include polystyrene, high impact polystyrene, polypropylene, filled polypropylene, nylon, and blends thereof such as 70% nylon/30% polyethylene oxide, 60% polystyrene/40% polyethylene oxide.

Optionally, the core can include additives such as lubricants, foaming agents, microspheres, baby powders, fillers such as $CaCO_3$, colorants such as $TiO_2$ silicone copolymers, sucrose stearate, vitamin E, panthenol, aloe, essential oils, e.g. methanol, and combinations thereof.

In an embodiment of the present invention a wear indicating effect is produced when the sheath and the core are made of disparately colored materials (e.g. white colored sheath and blue colored core). Upon use, the sheath at the skin engaging surface is typically worn off (or eroded) through use. With sufficient use, the second colored region represented by the core is exposed, thus, providing the user with an indication that the shaving unit and/or skin engaging surface have reached their effective life. In a preferred embodiment, the sheath consists of a polyethylene oxide/polystyrene mixture which is white in color and the core consists of nylon and/or styrene which has been colored with a FD&C Blue No. 2 dye. Other suitable dyes or pigments include FD&C Red. No. 40, Erythrosine (FD&C Red. No. 3), Brilliant Blue FCF (FD&C Blue No. 1), Indigotine (FD&C Blue No. 2), Tartrazine (FD&C Yellow No. 5), Sunset Yellow FCF (FD&C Yellow No. 6) and Fast Green FCF (FD&C Green No. 3) and Titanium Dioxide.

Figure 5:
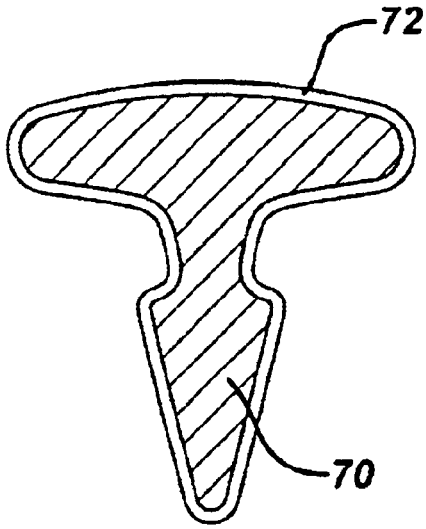
FIG. 5 is a sectional view taken along the line 3—3 of FIG. 4.
Figure 6:
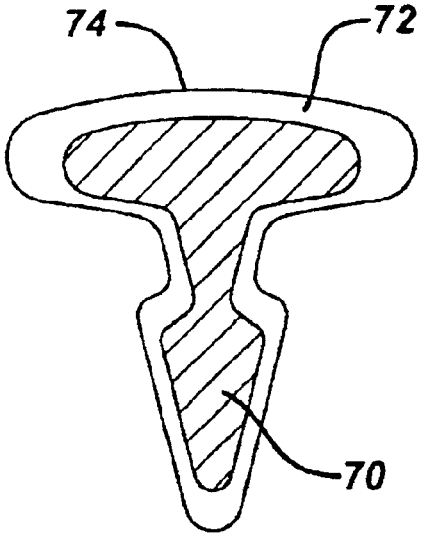
FIGS. 6–7 are sectional views in accordance with FIG. 5 wherein alternate core geometries are depicted.
Figure 7:
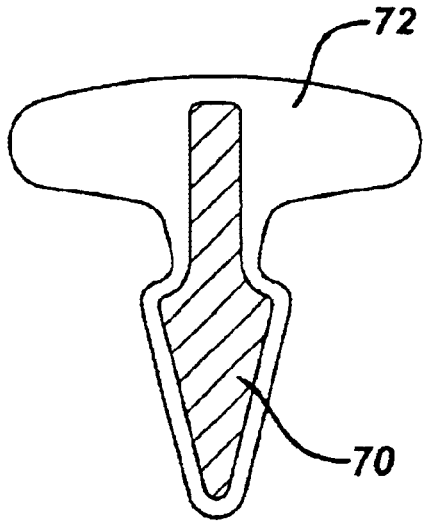

FIG. 5 depicts a cross section of an alternate skin engaging member. The core 70 follows the general contours of the surface defined by the outside of the sheath. FIG. 6 depicts a slight variation on that theme where a thicker sheath layer is provided along the skin engaging surface 74. Still further, FIG. 7 provides a cross-section wherein a very high degree of sheath material is present along the skin engaging surface.

Figure 8:
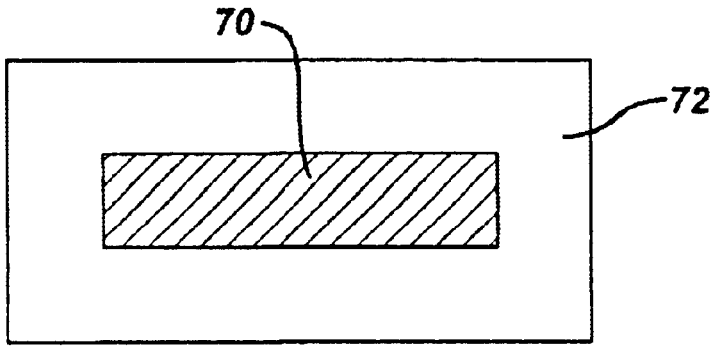
FIG. 8 is a cross-sectional view of the skin engaging member of FIG. 1.

Finally, FIG. 8 depicts the skin engaging member depicted in FIGS. 1 and 2. It is interesting to note that the core in this case provides mechanical strength to the unit yet is not vital to the mechanical locking of the unit. The skin engaging member of FIGS. 1 and 2 is affixed by adhesive.

According to the present invention, the skin engaging members may be affixed by adhesive such as Loctite Super Bonder 499, mechanical locking mechanism, thermal welds.

Figure 9:
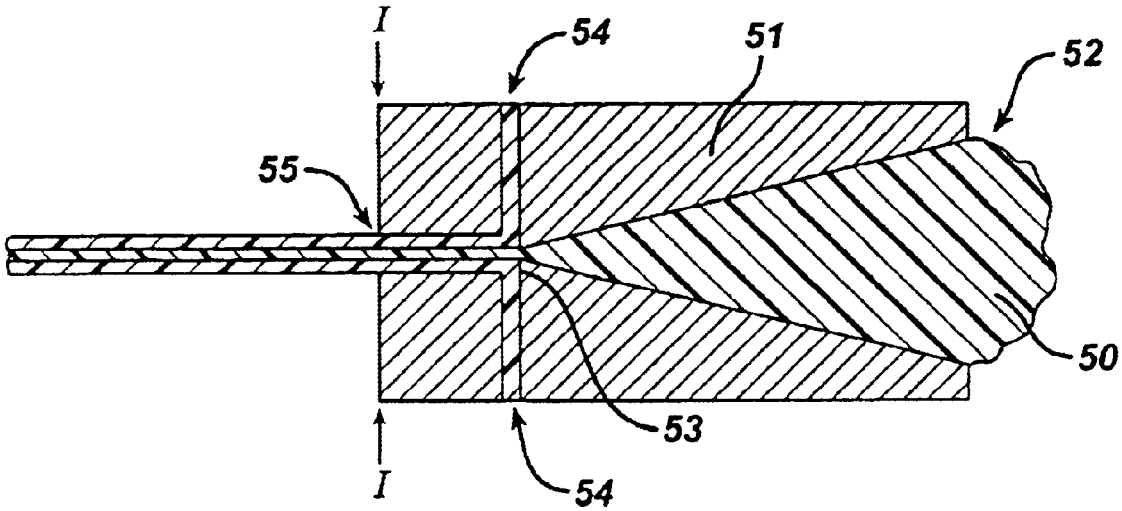
FIG. 9 is a schematic cross-section diagram of an extrusion die suitable for manufacturing the skin engaging member of FIG. 4.

FIG. 9 is a schematic cross section diagram of an extrusion die suitable for manufacturing the skin engaging member of the present invention. Core material 80 is fed into the intrusion die 81 by an extrusion screw, hot melt or other suitable means. In the core inlet port 82 the tight core orifice 83 encounters the sheath material 86, which has been fed into sheath inlet port 84, wherein the core becomes encapsulated by the sheath material when viewed in a transverse cross section to the flow of the die material. The encapsulated core then proceeds to the die outlet 85 wherein the continuous skin engaging members can be cured and/or drawn down to provide the appropriate dimensions. Also, it should be noted that the core material could consist of a solid wire or solid plastic material which is fed in through a conventional die to produce an encapsulated skin engaging member. For general discussion of coextrusion technology see Levy, *Plastics Extrusion Technology Handbook,* Industrial Press Inc., pages 168–188 (1981), incorporated herein by reference. After the continuous skin engaging members are produced, the strand is sent for further processing where it is typically drawn down to the correct size and cut to length suitable for implant into the body of a razor blade cartridge. This cutting can be achieved by knife edge cutting, lasers or water lasers. The skin engaging surfaces of the present invention typically are rectangular in shape with a width of from about 0.05 inches to about 0.1 inches and a length of about 1.2 inches.

Applicant considers equivalent embodiments to be part of the present invention. For example, non-rectangular skin engaging surface areas may be utilized (such as ovals) and non-flat surface patterns could be utilized. These and other equivalent embodiments are also contemplated by the present invention. The present invention and the manner of making and using the same should be evident from the following examples:

EXAMPLES

The following samples were coextruded with a cross-section as in FIG. 5.

| No. | Core Composition | Sheath Composition |
|---|---|---|
| 1 | Nylon 70%<br>blue pigment 0.5%<br>polyethylene oxide 29.5% | 10% polystyrene<br>76% polyethylene oxide<br>8% polyvinyl acetate<br>5% polyethylene glycol<br>1% white pigment |
| 2 | 25% polyethylene oxide<br>75% nylon | 78% polyethylene oxide<br>14% polystyrene<br>3% polyethylene glycol<br>5% polyvinyl alcohol |
| 3 | 100% polystyrene | 82% polyethylene oxide<br>14% polystyrene<br>3% polyethylene glycol<br>1% polyvinyl alcohol |
| 4 | 70% nylon<br>29.5% polyethylene oxide<br>0.5% blue dye | 80% polyethylene oxide<br>16% polystyrene<br>4% polyvinyl alcohol |
| 5 | 98% polystyrene<br>2% blue dye | 73% polyethylene oxide<br>5% Salsorb<br>5% polyvinyl alcohol |
| 6 | 100% polystyrene | 74% polyethylene oxide<br>10% polystyrene<br>10% polyvinyl alcohol<br>5% polyethylene glycol<br>1% white TiO2 pigment |

-continued

| No. | Core Composition | Sheath Composition |
|---|---|---|
| 7 | 98% polystyrene<br>2% blue dye | 68% polyethylene oxide<br>15% polyvinyl alcohol<br>10% polystyrene<br>5% polyethylene glycol<br>2% white TiO2 pigment |
| 8 | 100% polystyrene | 67% polyethylene oxide<br>4% Salsorb<br>14% polyvinyl alcohol<br>10% polystyrene<br>4% polyethylene glycol<br>1% white TiO2 pigment |
| 9 | 99% polystyrene<br>1% blue dye | 68% polyethylene oxide<br>20% polyvinyl alcohol<br>10% polystyrene<br>2% white TiO2 pigment |
| 10 | 99% polystyrene<br>1% blue dye | 70% polyethylene oxide<br>13% polyvinyl alcohol<br>15% polystyrene<br>2% white TiO2 pigment |
| 11 | 99% polystyrene<br>1% blue dye | 65% polyethylene oxide<br>15% polyvinyl alcohol<br>15% polystyrene<br>3% Salsorb<br>2% white TiO2 pigment |
| 12 | 99% polystyrene<br>1% blue dye | 65% polyethylene oxide<br>10% polyvinyl alcohol<br>15% polystyrene<br>3% Salsorb<br>2% white TiO2 pigment |

Example 13

The following procedure can be used to produce a skin engaging member of the type depicted in FIG. 4.

The extrusion equipment includes two single-screw extruders, a die cross-head, a cooling channel, and a puller. The strip extruded from the extruders is pulled through a cooling tunnel by a Farris puller (a take-off machine) at a speed of approximately 10 feet per minute with minimum tension on the strip. The strip is air-cooled by blowing dry compressed air into the tunnel at approximately 10 CFM. The extrudate is kept in a cool, dry room.

The core blend (70% Zytel 330 brand amorphous nylon/blue pigment,30% polyethylene oxide blend 60/40 is extruded through the first ¾" Haake extruder (barrel pressure of 4,343 psi and temperature of 180° C.). The sheath blend (80% polyethylene oxide blend 60/40, 14% polystyrene white color, 3% PEG, and 3% PVA 2025) is extruded through the second ¾" Haake extruder (barrel pressure of 6,131 psi and temperature of 180° C.). The two materials are then joined and are fed through a cross-head at a temperature of 180° C., die temperature of 180° C., and die pressure of 3,600 psi to form a continuous lubricating strip. The line speed is approximately 10 FPM.

What is claimed is:

1. A skin engaging member in the form of a narrow elongated strip of dimensions suitable for placement on a razor cartridge, said skin engaging member comprising two disparately colored, solid polymeric layers, said layers comprising an erodible skin engaging layer of a first color overlying a non-skin engaging layer of a different color, said skin engaging layer comprising a blend of an amount of water soluble shaving aid and a water insoluble polymer, said shaving aid being water-leachable from said skin-engaging layer, and said non-skin engaging layer comprising a water insoluble polymer, wherein said skin engaging layer erodes during shaving to provide a color change that signals that the razor cartridge should be replaced.

2. The skin engaging member of claim 1 wherein said water soluble shaving aid comprises polyethylene oxide.

3. The skin engaging member of claim 2 wherein said water insoluble polymer is said skin engaging layer comprises a polymer selected from the group consisting of nylon, ethylene vinyl acetate, polyethylene, polypropylene, polystyrene and polyacetal.

4. The skin engaging member of claim 3 wherein said water insoluble polymer is said non-skin engaging layer comprises a polymer selected from the group consisting of polystyrene, high impact polystyrene, polypropylene, filled polypropylene and nylon.

5. The skin engaging member of claim 4 wherein said non-skin engaging layer additionally comprises a water soluble polymer.

6. The skin engaging member of claim 1 wherein said skin engaging layer comprises an elongated sheath and said non-skin engaging layer comprises a core extending axially throughout said sheath.

7. A razor cartridge comprising a blade and a skin engaging member affixed adjacent said blade, said skin engaging member in the form of a narrow elongated strip of dimensions suitable for placement on the razor cartridge, said skin engaging member comprising two disparately colored, solid polymeric layers, said layers comprising an erodible skin engaging layer of a first color overlying a non-skin engaging layer of a different color, said skin engaging layer comprising a blend of an amount of water soluble shaving aid and a water insoluble polymer, said shaving aid being water-leachable from said skin-engaging layer, and said non-skin engaging layer comprising a water insoluble polymer, wherein said skin engaging layer erodes during shaving to provide a color change that signals that the razor cartridge should be replaced.

8. The razor cartridge of claim 7 wherein said water soluble shaving aid comprises polyethylene oxide.

* * * * *

UNITED STATES PATENT AND TRADEMARK OFFICE

CERTIFICATE OF CORRECTION

PATENT NO. : 6,944,952 B1
APPLICATION NO. : 08/926819
DATED : September 20, 2005
INVENTOR(S) : Mingchih M. Tseng It is certified that error appears in the above-identified patent and that said Letters Patent is hereby corrected as shown below:

Title page,
Item [*] Notice, after "days" insert -- This patent is subject to a terminal disclaimer. --.

Signed and Sealed this

Eighteenth Day of July, 2006

JON W. DUDAS
*Director of the United States Patent and Trademark Office*